United States Patent [19]

Naumann

[11] 4,188,027

[45] Feb. 12, 1980

[54] APPARATUS FOR LATERALLY POSITIONING SHEETS IN PRINTING MACHINES OR THE LIKE

[76] Inventor: Reinhard Naumann, Securiusstr. 32, 727 Delitzsch, German Democratic Rep.

[21] Appl. No.: 805,391

[22] Filed: Jun. 10, 1977

[30] Foreign Application Priority Data

Jun. 11, 1976 [DD] German Democratic Rep. ... 193317
Feb. 21, 1977 [DD] German Democratic Rep. ... 197486

[51] Int. Cl.[2] ..... B65H 9/12
[52] U.S. Cl. ..... 271/241; 271/250
[58] Field of Search ..... 271/241, 248, 250, 252

[56] References Cited

U.S. PATENT DOCUMENTS

| | | | |
|---|---|---|---|
| 2,165,172 | 7/1939 | Backhouse | 271/252 |
| 3,860,233 | 1/1975 | Wiase | 271/241 |

*Primary Examiner*—Richard A. Schacher
*Attorney, Agent, or Firm*—Michael J. Striker

[57] ABSTRACT

A printing machine has a sheet support surface along which a succession of sheets pass adjacent a lateral stop. An apparatus for laterally positioning the sheets against the stop has a displacer member which is laterally displaceable under the support surface between an outer position extending beyond the lateral stop and an inner position generally underneath and close to the lateral stop. A suction drawbar is limitedly laterally displaceable on the displacer member between a pair of end positions and has at least one suction aperture exposed at the support surface. Air is aspirated downwardly through this aperture so as to draw a sheet overlying the suction drawbar on the support surface against the drawbar. Lateral displacement of the displacer member from the outer position into its inner position displaces a sheet drawn suctionally against the drawbar laterally against the lateral stop. A biasing arrangement including at least one spring is provided for urging the drawbar on the displacer member into one of its end positions and for simultaneously permitting displacement of the drawbar on the displacer member toward the other of its end position against a predetermined biasing force of such magnitude that on engagement of a sheet held suctionally by the drawbar with the stop the drawbar moves relative to the displacer member.

10 Claims, 3 Drawing Figures

APPARATUS FOR LATERALLY POSITIONING SHEETS IN PRINTING MACHINES OR THE LIKE

FIELD OF THE INVENTION

Figure 1:
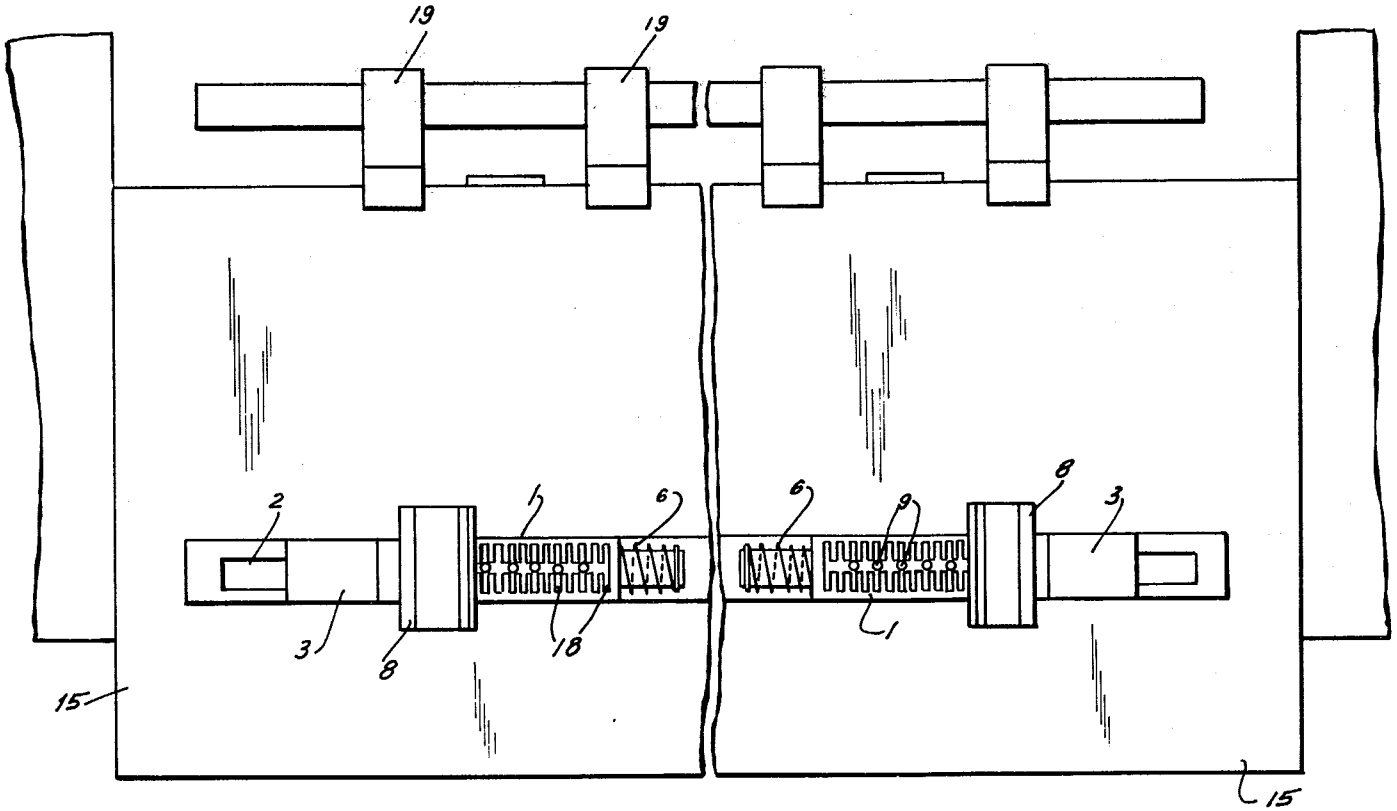

The invention relates to an apparatus for laterally positioning sheets in printing machines or the like by means of one or more suction drawbars operated by pneumatic suction.

FEATURES OF THE KNOWN TECHNICAL SOLUTIONS

Apparatuses are known in printing machines for the lateral positioning of workpieces, in particular printing sheets, which position the printing sheets fed sheet-by-sheet to the printing machine relative to adjustable lateral stops by means of suction drawbars each connected to a pneumatic suction line and displaceable partially or fully transversely across the feed table while being flush with the table surface. The suction bars are actuated with pneumatic suction which draws the sheets lying on the suction drawbars downwardly and pulls them against the lateral stop. With these devices the pneumatic suction should be so regulated that when the sheet is properly positioned slip can exist between the suction drawbars and the sheets, when the suction drawbars are moving to their end positions and the sheets lie on the lateral stop and also on the other hand to eliminate a wrinkling of the sheet by the lateral stops. It is almost a practical impossibility to maintain such a difficult setting of the pneumatic suction pressure. In particular when the machine is operating at high speed the printing sheets strike forcefully on the lateral stops so that if these stops are not aligned with the center of the sheets the inertia of the sheet can turn the sheet about the lateral stops, which effect is even further increased by the possibility of slip between the sheets and the suction drawbar. If the suction at the suction apertures of the suction drawbar is too great the edge of the sheet can be damaged against the lateral stops. With too little suction on the other hand the sheets are partially only inadequately drawn up against the lateral stops.

German Pat. No. 972,459 aimed at overcoming this disadvantageous functioning in a pneumatic lateral drawing arrangement for positioning sheets. The sheets are pneumatically gripped adjacent their edges to be positioned by means of a suction aperture on the suction drawbar and are supposed to be drawn against the lateral stops with adjustably variable drawing pressure. More particularly there is a control aperture arranged in front of this stop on the feed table connected with a control device for the suction of the suction nozzle which is formed as a vacuum pump and which after covering of the control aperture by the sheet moving in the sheet displacement direction reduces or cuts off the suction to the suction aperture. In this manner the pressure decrease is regulatable independently of the size and position of the control aperture by the shape of the opening in the valve slide of the control device. This arrangement is relatively prone to failure due to its complicated construction and functioning. In addition the tolerances in the paper thickness have a negative effect on the desired suction in that the control aperture sucks down the fed sheets at different times and therefore analogously the control device reacts at different times. This has the result that the sheet is held temporarily by the suction aperture with too little or too great suction.

Furthermore this arrangement does not exclude the possibility that in particular with high machine speeds the sheets are wrinkled by the lateral stops, are turned thereby, or are damaged on their outer edges. In addition this device is too sluggish for use with very high machine operating speeds so that as a result the desired pressure cannot be counted on to appear with each positioning cycle at the necessary time at the suction aperture.

OBJECT OF THE INVENTION

It is an object of the invention to develop a device for the lateral positioning of sheets which is uncomplicated both in its construction and in its function and simultaneously has an optimal accuracy with respect to the sheet positioning.

SUMMARY OF THE INVENTION

It is an object of the invention to provide an apparatus for laterally positioning printing sheets, which can operate at high machine speeds to give an exact correction of the sheet position on the lateral stops without wrinkling the sheets there, turning them, or damaging their outer edges, while using the maximal possible pressure available at the suction-pressure source and thereby usable for the sheet positioning.

This object is attained according to the invention with a tubular suction drawbar which is axially slidable on a support bar extending transversely to the sheet displacement direction and traversed by a pneumatic suction conduit, which suction drawbar is provided with suction holes which communicate with suction holes provided in the support bar and wherein the lost-motion relative displacement of the support bar relative to the suction drawbar is compensated for by means of a spring. The support bar is affixed to a displacer bar which is slidable on a support frame of the printing machine. The spring can be a compression spring and bears on the support bar to bias the suction drawbar into its normal starting position. In order to vary the force the spring pressure can be adjusted. In addition it is possible to form the spring as a pneumatic cushion, advantageously as a pneumatic cylinder provided with one or more throttle valves. The use of the throttle valves ensures the adjustability both of the holding pressure as well as of the displacement speed of the suction drawbar. It is advantageous to provide the support bar with two pneumatic suction conduits, with the one pneumatic suction conduit only connected with the pneumatic cylinder preferably formed by the support bar and the suction drawbar so that the holding pressure of the suction drawbar and the vacuum in the cylinder can be cut off at different times. For most efficient use of the suction the suction drawbar has grooves on its sucking surface which are connected to one another and with the suction holes. In addition the device according to the invention insures that if necessary the holding pressure between the sheet and the suction drawbar can correspond to the maximum producible suction and is always greater than the sum of the displacement forces—spring force as well as sheet inertia—effective on the suction drawbar. In addition the lateral positioning of sheets is possible at great machine speeds since it is no longer necessary to provide a complicated device for the difficult adjustment of the suction and in connection therewith of the instant for the interruption of the suction on engagement of the sheet edge on the lateral stop. Indeed the spring compensates for the lost-motion displacement due to the constant large displacement of the suction drawbar. Indeed in accordance with the invention with the desired working-together of the suction drawbar and the support bar the sheet can be held with the maximum holding force without being damaged or bouncing away from the lateral stop which makes it possible to obtain extremely good registration in the printing operation.

SPECIFIC EMBODIMENT

Figure 2:
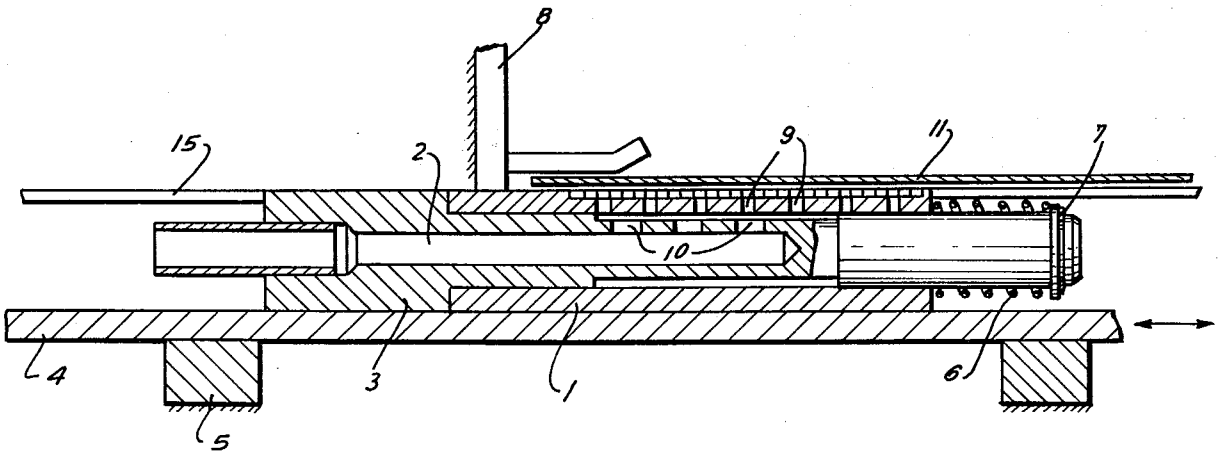
Figure 3:
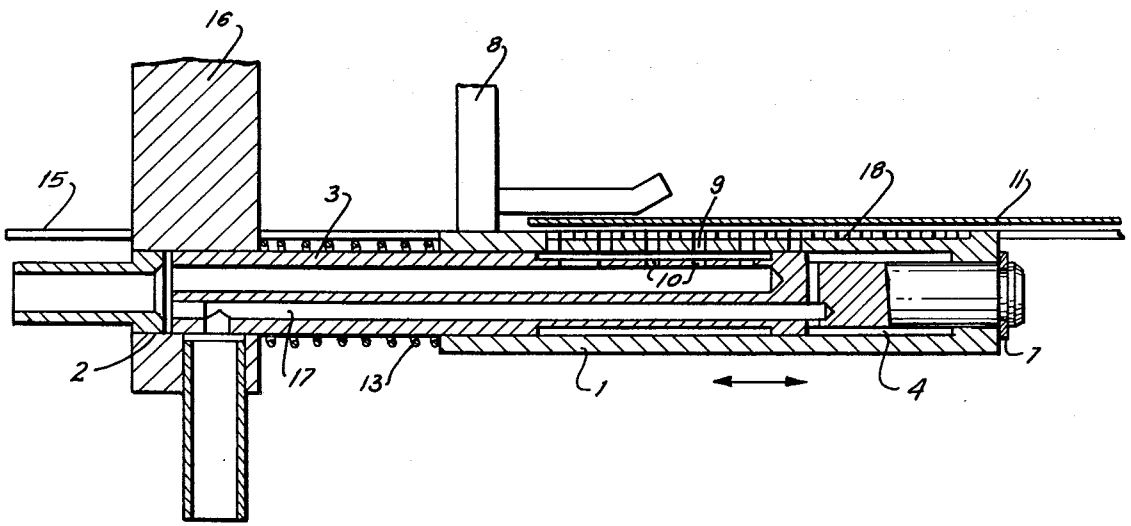

The invention is described below with reference to two embodiments. In the drawings there is shown in:

FIG. 1 a top view of two mechanically operated devices on the support table of a printing machine, FIG. 2 a longitudinal section through a mechanically operated device, and FIG. 3 a longitudinal section through a pneumatically operated device.

SPECIFIC DESCRIPTION OF PREFERRED EMBODIMENTS

As shown in FIG. 1 two devices of an arrangement according to this invention are arranged slidable transversely to the sheet displacement path and according to sheet type, wherein their suction drawbars 1 lie in the plane of the support table 15.

FIG. 2 shows that the tubular suction drawbar 1 is axially slidably guided on a support bar 3 extending transverse to the sheet displacement direction and traversed by a pneumatic suction conduit 2. The support bar 3 and the displacer bar 4 are rigidly connected with each other and slidable on the support frame 5. A spring 6 is braced on the support bar 3 for taking up the lost-motion displacement of the suction drawbar 1, which spring is held in its operative position at one end on the support bar 3 by a removable snap ring 7. The compression spring 6 biases the suction drawbar 1 at the end of a drawing operation into its normal starting position in which the suction drawbar 1 extends outwardly over the lateral stop 8 arranged above it. The suction drawbar 1 is provided with suction holes 9 which communicate with suction holes 10 formed in the support bar 3.

Each of the sheets 11 moving along in the sheet displacement path is drawn synchronously with operation of the machine onto the lateral stop 8 and straightened out. The displacer bar 4 and support bar 3 move during this operation from the working position under the sheet 11 into the normal position beyond the lateral stops 8. In the working position the sheet 11 is sucked with maximum force against the suction drawbar 1 and drawn toward the lateral stop 8. After contact of the sheet 11 the suction drawbar 1 remains in this position until the synchronous interruption of the suction takes place and it is pushed by the compression spring 6 into its starting position. The overshooting of the displacer bar 4 and the support bar 3 after the sheet straightening is compensated for by the compression spring 6.

The second embodiment according to FIG. 3, a pneumatically powered device, is comparable in its basic structure with the mechanically driven device. More particularly there is fixed on the frame 16 for slidable guiding of the suction drawbar 1 a support bar 3 which is formed cylindrically and stepped. The suction drawbar 1 is mounted on the large-diameter portion of the support bar 3 and is pressed into its functional normal position on the snap rings 7 by the compression spring 13 braced between the frame 16 and the suction drawbar 1. The support bar 3 is traversed by the pneumatic suction lines 2 and 17. The pneumatic suction line 2 communicates by means of the suction holes 10 of the support bar 3 with the suction holes 9 of the suction drawbar 1 and the pneumatic suction conduit 17 with the pneumatic working cylinder 14 formed by the suction drawbar 1 and the small-diameter portion of the support bar 3.

In order to obtain a uniform suction over the entire sucking area of the suction drawbar 1 on the respective sheet 11 to be displaced there is provided in both arrangements a sucking surface with grooves 18 which are connected with one another and with the suction holes 9.

Suction is applied to the suction drawbar 1 under the sheet 11 via the pneumatic suction lines 2 and 17 to effect maximum holding power with the suction holes 9 and the grooves 18, while as a result of the action of the working cylinder 14 the suction drawbar 1 is simultaneously drawn toward the lateral stop 8. In this manner damaging of the sheet 11 and springing up of it from the stop 8 is impossible. After straightening-out of the sheet 11 suction is no longer applied via the line 2 so that the suction drawbar 1 can continue to move toward the stop 8 until it abuts the frame 16 under the suction force in the cylinder 14, so that a sliding of the sheet 11 before its pick up by a transfer gripper 19 is also excluded. Only after the sheet is transferred is the suction on the line 17 also interrupted so that the suction drawbar 1 is pushed by the compression spring 13 into its starting position.

I claim:

1. In combination with a machine having a sheet support surface having a lateral stop, an apparatus for laterally positioning a sheet against said stop and comprising:

a displacer member laterally displaceable under said support surface between an outer position extending beyond said lateral stop and an inner position generally underneath and close to said lateral stop;

a suction drawbar limitedly laterally displaceable on said displacer member between a pair of end positions and having at least one suction aperture exposed at said surface;

means for aspirating air downwardly through said aperture and thereby drawing a sheet overlying said suction drawbar on said surface against said drawbar;

means for laterally displacing said displacer member from said outer position into said inner position and thereby displacing a sheet drawn suctionally against said drawbar laterally against said lateral stop; and biasing means including a spring for urging said drawbar on said displacer member into one of said end positions and for simultaneously permitting displacement of said drawbar on said displacer member toward the other of said end positions against a predetermined biasing force of such magnitude that on engagement of a sheet held suctionally by said drawbar with said stop said drawbar moves relative to said displacer member.

2. The apparatus defined in claim 1 wherein said spring is a compression spring braced between said displacer member and said drawbar.

3. The apparatus defined in claim 2 wherein said displacer is formed with a throughgoing suction passage connected to said means for aspirating and communicating with said aperture.

4. The apparatus defined in claim 3 wherein said drawbar is formed with a plurality of such apertures exposed at said surface.

5. The apparatus defined in claim 4 wherein said spring biases said drawbar in a direction toward said lateral stop and toward said inner position of said displacer member, said spring substantially exclusively establishing said biasing force.

6. The apparatus defined in claim 4 wherein said displacer member and said drawbar together form a substantially closed chamber pressurizable to displace said drawbar against said spring, said apparatus further comprising means for depressurizing said chamber and thereby balancing the pneumatic force of said chamber against the spring force of said spring with the difference being equal to said biasing force.

7. The apparatus defined in claim 6 wherein said drawbar is formed with another passage opening into said chamber and constituting part of said means for depressurizing.

8. The apparatus defined in claim 4 wherein said drawbar is tubular and concentric to said displacer member.

9. The apparatus defined in claim 4 wherein said drawbar is formed with surface grooves at said aperture.

10. The apparatus defined in claim 4 wherein said displacer member includes a support bar and fixed thereto a displacer bar extending concentrically laterally into said drawbar.

* * * * *